US007927074B2

(12) United States Patent
Sun et al.

(10) Patent No.: US 7,927,074 B2
(45) Date of Patent: Apr. 19, 2011

(54) FAN ROTOR

(75) Inventors: Hong Sun, Shenzhen (CN); Yong-Kang Zhang, Shenzhen (CN); Ying-Min Huang, Taipei Hsien (TW); Jian-Feng Yan, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 888 days.

(21) Appl. No.: 11/854,479

(22) Filed: Sep. 12, 2007

(65) Prior Publication Data

US 2009/0035149 A1 Feb. 5, 2009

(30) Foreign Application Priority Data

Aug. 3, 2007 (CN) ..... 2007 1 0075615

(51) Int. Cl.
*F01D 5/28* (2006.01)

(52) U.S. Cl. ..... 416/144; 416/190

(58) Field of Classification Search ..... 416/144, 416/190

See application file for complete search history.

(56) References Cited

U.S. PATENT DOCUMENTS

| | | | | |
|---|---|---|---|---|
| 5,547,365 | A * | 8/1996 | Chuang | 425/577 |
| 7,063,507 | B2 * | 6/2006 | Hsieh | 416/144 |
| 7,364,400 | B2 * | 4/2008 | Ku et al. | 415/111 |
| 7,364,403 | B2 * | 4/2008 | Wu et al. | 415/175 |
| 2006/0269412 | A1 * | 11/2006 | Yu et al. | 416/144 |

* cited by examiner

*Primary Examiner* — Igor Kershteyn
(74) *Attorney, Agent, or Firm* — Jeffrey T. Knapp

(57) ABSTRACT

A fan rotor includes a hub (10), a plurality of blades (20) radially disposed around the hub, and a magnet (30) located in an inner side of the hub. The hub includes a top wall (12) and a sidewall (14) surrounding the top wall. A plurality of spaced first ribs (17) is disposed between the top wall of the hub and a top wall of the magnet. A plurality of spaces (171) is formed between adjacent first ribs for accommodating equilibrium clay (50) therein.

12 Claims, 2 Drawing Sheets

FAN ROTOR

BACKGROUND OF THE INVENTION

1. Field of the Invention

The present invention relates generally to fan rotors, and more particularly to a fan rotor capable of preventing wet equilibrium clay from flying away therefrom during rotation of the fan rotor when a fan incorporating the fan rotor is under test.

2. Description of Related Art

In manufacturing of heat dissipating fans, calibration of weight balance of fan rotors is proceeded with by disposing equilibrium clay on blades of the rotors. The equilibrium clay functions as counterweight for the rotors. After the disposition of a proper amount of equilibrium clay on the blades, the fan together with the rotor is immediately brought to undergo a series of tests, such as jitter test and performance test of electronic parts of the fan, during which the equilibrium clay is still wet and not desiccated. During these tests, the wet equilibrium clay may shift from its original position or even fly away from the rotor due to centrifugal force generated by rotation of the rotor. This jeopardizes the stability of the rotor during operation of the heat dissipating fan.

In order to solve this problem, the rotor is usually laid out for 2 to 8 hours so as to desiccate the equilibrium clay before the tests. This prolongs the time for manufacturing the rotor and further decreases the efficiency for manufacturing the heat dissipating fan.

Therefore, how to prevent the wet equilibrium clay from moving along or flying away from the rotor during the test of the fan is the key in increasing the efficiency for manufacturing the heat dissipating fan.

SUMMARY OF THE INVENTION

The present invention relates to a fan rotor capable of preventing wet equilibrium clay from moving therealong or flying away therefrom during test of a fan incorporating the fan rotor. The fan rotor includes a hub, a plurality of blades radially disposed around the hub, and a magnet located in an inner side of the hub. The hub includes a top wall and a sidewall surrounding the top wall. A plurality of spaced first ribs is disposed between the top wall of the hub and a top wall of the magnet. A plurality of spaces is formed between adjacent first ribs for accommodating equilibrium clay therein.

Other advantages and novel features of the present invention will become more apparent from the following detailed description of first embodiments when taken in conjunction with the accompanying drawings, in which:

DETAILED DESCRIPTION OF THE INVENTION

Figure 1:
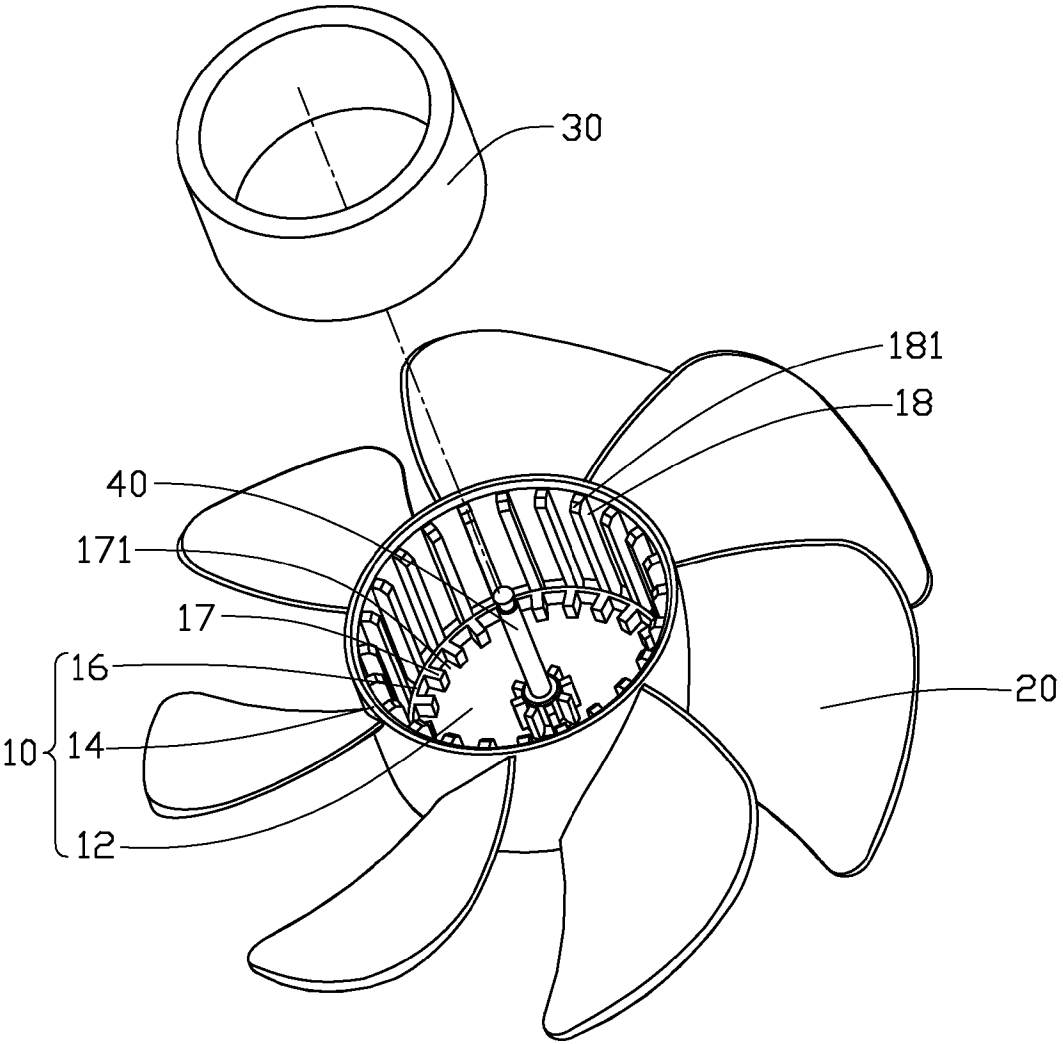
FIG. 1 is an exploded, isometric view of a fan rotor in accordance with a preferred embodiment of the present invention.

Reference will now be made to the drawing figures to describe the first embodiment in detail.

Referring to FIG. 1, a fan rotor in accordance with a preferred embodiment of the present invention is shown. The fan rotor includes a hub 10, a plurality of blades 20 radially and outwardly extending from an outer side of the hub 10, an annular magnet 30 attached to an inner side of the hub 10, and a shaft 40 fixed to and extending downwardly from a center of the hub 10.

The hub 10 is U-like in profile, and has an open end and an opposite closed end. The hub 10 includes a rounded top wall 12 at the closed end thereof, and an annular sidewall 14 integrally and downwardly extending from a periphery of the top wall 12. The hub 10 further includes a ring-like projection 16 at a joint of the top wall 12 and the sidewall 14. A plurality of spaced first ribs 17 radially and inwardly extend from an inner face of the projection 16 towards a centre of the top wall 12. The first ribs 17 are integrally formed with the projection 16, the sidewall 14 and the top wall 12 of the hub 10 from a single piece. A plurality of spaced second ribs 18 extend axially and downwardly from a bottom face of the projection 16, and integrally form with the projection 16 and the sidewall 14 of the hub 10 from a single piece. A radial length of each of the first ribs 17 substantially equals to a thickness of the annular magnet 30. An axial length of each of the second ribs 18 substantially equals to a height of the annular magnet 30. Each of the second ribs 18 has a slantwise guiding surface 181 at a free corner of a bottom end thereof. The guiding surface 181 extends downwardly and outwardly from an inner surface (not labeled) of the second rib 18. The annular magnet 30 is received in an inner space enclosed by the sidewall 14 of the hub 10 and abuts against the inner surfaces of the second ribs 18.

Figure 2:
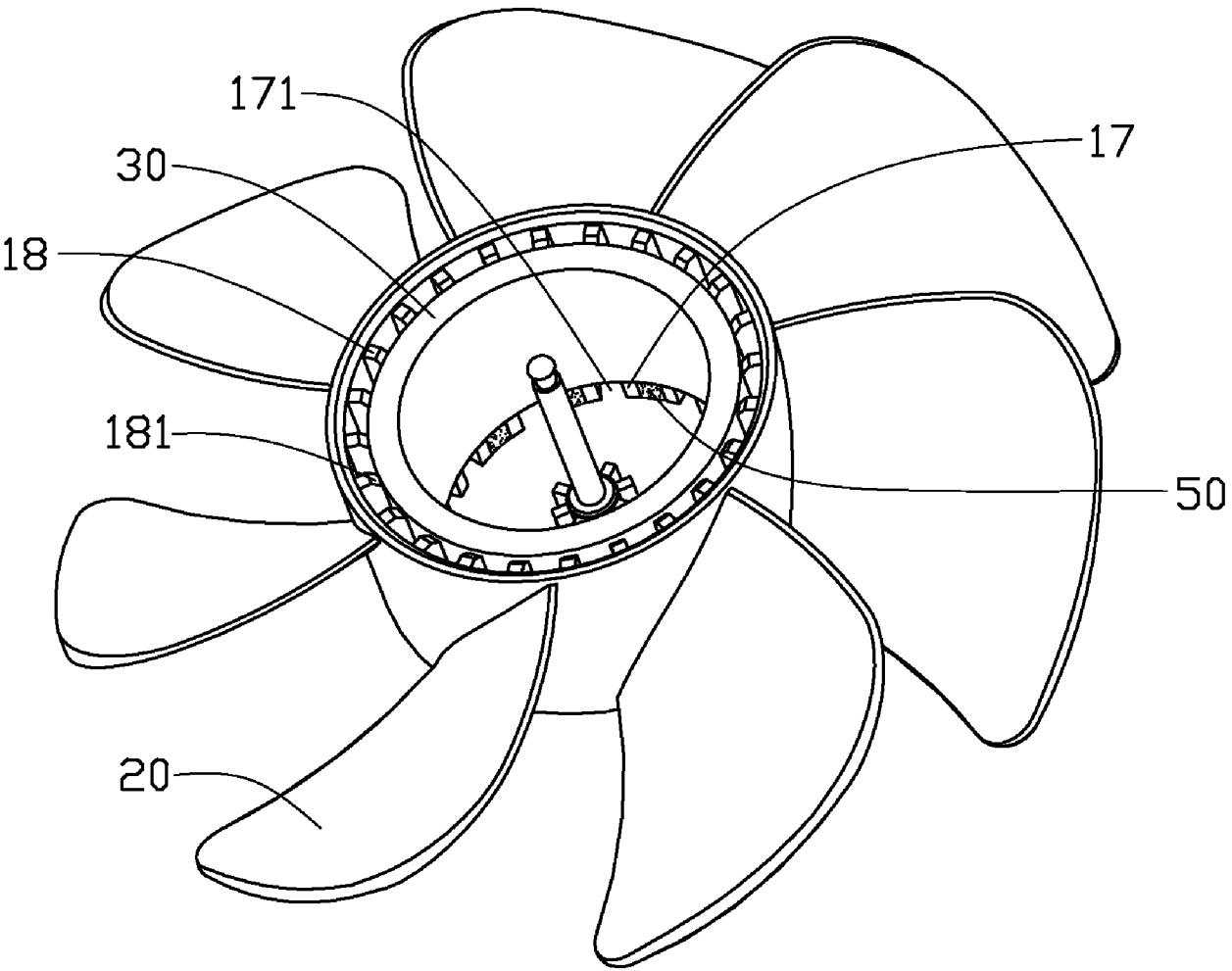
FIG. 2 is an assembled view of the fan rotor of FIG. 1.

Referring to FIG. 2, in assembly of the annular magnet 30 to the hub 10, wet equilibrium clay 50 is first filled into some of spaces 171 formed between adjacent first ribs 17. The quantity and position of the spaces 171 which are filled with the wet equilibrium clay 50 are determined during the calibration of the weight balance of the fan rotor. The annular magnet 30 is then placed at the open end of the hub 10 with a top portion of annular magnet 30 received in a bottom end of the inner space of the hub 10. The annular magnet 30 is pressed and guided by the guiding surfaces 181 of the second ribs 18 to move upwardly towards the top wall 12 of the hub 10 until a top surface of the annular magnet 30 contacts with bottom surfaces of the first ribs 17. The wet equilibrium clay 50 is therefore received in the spaces 171 formed between adjacent first ribs 17 and supported by the top surface of the annular magnet 30. This prevents the wet equilibrium clay 50 from moving along or flying away from the fan rotor during the following different tests of the fan when the fan rotor is rotated. Therefore, the time for manufacturing the fan rotor and accordingly the fan is shortened without decreasing the stability of the fan rotor.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A fan rotor comprising:

a hub comprising a top wall and a sidewall surrounding the top wall;

a plurality of blades radially disposed around an outer side of the sidewall of the hub;

a magnet located in an inner side of the sidewall of the hub;

a plurality of spaced first ribs disposed between the top wall of the hub and a top face of the magnet, a plurality of spaces being formed between adjacent first ribs and configured for accommodating equilibrium clay therein.

2. The fan rotor as described in claim 1, further comprising a plurality of spaced second ribs disposed between the sidewall of the hub and a sidewall of the magnet.

3. The fan rotor as described in claim 2, wherein each of the second ribs comprises a slantwise guiding surface formed at a free corner of a bottom end thereof, and the guiding surfaces are configured for facilitating insertion of the magnet in the inner side of the sidewall of the hub.

4. The fan rotor as described in claim 2, wherein the first and the second ribs are integrally formed with the hub as a single piece.

5. The fan rotor as described in claim 2, wherein the hub further comprises a projection located at a joint of the top wall and the sidewall thereof, the first ribs radially and inwardly extending from an inner face of the projection, the second ribs axially and downwardly extending from a bottom face of the projection.

6. A fan rotor comprising:

a hub having a top wall and an annular sidewall extending downwardly from a periphery of the top wall;

a magnet received in the hub, wherein a space is defined between a top face of the magnet and the top wall of the hub; and equilibrium clay being received in the space and directly contacting the top face of the magnet, the equilibrium clay functioning as counterweight for achieving weight balance of the fan rotor.

7. The fan rotor as described in claim 6, wherein the top wall comprises a plurality of spaced first ribs located adjacent to the annular sidewall of the hub, the top face of the magnet abutting bottoms of the first ribs, the first ribs dividing the space into a plurality of sub-spaces, and the equilibrium clay being received in at least one of the sub-spaces.

8. The fan rotor as described in claim 7, wherein the hub comprises a plurality of spaced second ribs extending inwardly from the annular sidewall to engage with the magnet.

9. The fan rotor as described in claim 8, wherein each of the spaced second ribs comprises a bottom end forming a slantwise guiding face extending downwardly and outwardly from an inner surface of the each of the spaced second ribs.

10. A fan rotor comprising:

a hub comprising a top wall and an annular sidewall extending downwardly from a periphery of the top wall;

a magnet received in the hub, wherein a space is defined between a top face of the magnet and the top wall of the hub; and equilibrium clay received in the space, the equilibrium clay functioning as counterweight for achieving weight balance of the fan rotor;

wherein the top wall comprises a plurality of spaced first ribs located adjacent to the annular sidewall of the hub, the top face of the magnet abutting bottoms of the first ribs, the first ribs dividing the space into a plurality of sub-spaces, and the equilibrium clay being received in at least one of the sub-spaces.

11. The fan rotor as described in claim 10, wherein the hub comprises a plurality of spaced second ribs extending inwardly from the annular sidewall to engage with the magnet.

12. The fan rotor as described in claim 11, wherein each of the spaced second ribs comprises a bottom end forming a slantwise guiding face extending downwardly and outwardly from an inner surface of the each of the spaced second ribs.

* * * * *